US011539159B2

(12) United States Patent
Urbaniak et al.

(10) Patent No.: US 11,539,159 B2
(45) Date of Patent: Dec. 27, 2022

(54) PLUG CONNECTOR

(71) Applicant: VOLKSWAGEN AKTIENGESELLSCHAFT, Wolfsburg (DE)

(72) Inventors: Andreas Urbaniak, Münster (DE); Thomas Kaluba, Solingen (DE); Eduard Cvasa, Bochum (DE); Achim Rosemann, Wuppertal (DE); Ufuk Cecen, Wolfsburg (DE); Ingo Eckhardt, Leiferde (DE)

(73) Assignee: Volkswagen Aktiengesellschaft

( * ) Notice: Subject to any disclaimer, the term of this patent is extended or adjusted under 35 U.S.C. 154(b) by 0 days.

(21) Appl. No.: 17/268,610

(22) PCT Filed: Aug. 15, 2019

(86) PCT No.: PCT/EP2019/071941
§ 371 (c)(1),
(2) Date: Feb. 16, 2021

(87) PCT Pub. No.: WO2020/035566
PCT Pub. Date: Feb. 20, 2020

(65) Prior Publication Data

US 2021/0242621 A1 Aug. 5, 2021

(30) Foreign Application Priority Data

Aug. 17, 2018 (DE) ..... 10 2018 120 104.4

(51) Int. Cl.
*H01R 13/52* (2006.01)
*H01R 43/00* (2006.01)

(52) U.S. Cl.
CPC ..... *H01R 13/5208* (2013.01); *H01R 43/005* (2013.01)

(58) Field of Classification Search
CPC ..... H01R 13/5208; H01R 43/005; H01R 13/521; H01R 13/5202; H01R 13/5205; H01R 13/5221
See application file for complete search history.

(56) References Cited

U.S. PATENT DOCUMENTS 5,613,868 A * 3/1997 Ohsumi ..... H01R 13/5221 439/275
5,709,563 A 1/1998 Saito
(Continued)

FOREIGN PATENT DOCUMENTS

DE 19641408 A1 4/1997
DE 69937083 T2 6/2008
(Continued)

OTHER PUBLICATIONS

Search Report for International Patent Application No. PCT/EP2019/071941; dated Nov. 15, 2019.

*Primary Examiner* — Travis S Chambers
(74) *Attorney, Agent, or Firm* — Barnes & Thornburg LLP

(57) ABSTRACT

A plug connector for providing an electrical connection, having a collective seal with at least one passage opening and at least one electrically conductive plug contact, which is guided through the at least one passage opening of the collective seal. Also disclosed is a template for the passage opening to support the plug contact when the plug contact is guided through the passage opening of the collective seal.

15 Claims, 4 Drawing Sheets

(56) References Cited

U.S. PATENT DOCUMENTS

| | | | | |
|---|---|---|---|---|
| 5,931,699 | A * | 8/1999 | Saito | H01R 13/5208 439/275 |
| 6,174,200 | B1 * | 1/2001 | Bigotto | H01R 13/5208 439/587 |
| 6,398,585 | B1 * | 6/2002 | Fukuda | H01R 13/5208 439/587 |
| 8,969,741 | B2 * | 3/2015 | Aldrich | H02G 3/083 174/653 |
| 2005/0159046 | A1 | 7/2005 | Drescher | |
| 2006/0189191 | A1 | 8/2006 | Drescher et al. | |
| 2016/0315413 | A1 * | 10/2016 | Kobayashi | H01R 13/443 |

FOREIGN PATENT DOCUMENTS

| | | | | |
|---|---|---|---|---|
| DE | 102011006836 | A1 | 10/2012 | |
| EP | 1001496 | A2 | 5/2000 | |
| EP | 1172896 | A2 * | 1/2002 | H01R 13/5208 |
| EP | 1556924 | A1 | 7/2005 | |
| EP | 2555338 | A2 | 2/2013 | |
| FR | 2930081 | A1 * | 10/2009 | H01R 13/521 |
| JP | 2002122524 | A | 4/2002 | |
| JP | 2002164143 | A | 6/2002 | |
| JP | 2003092165 | A | 3/2003 | |
| JP | 2013073719 | A | 4/2013 | |
| JP | 2014017171 | A | 1/2014 | |
| JP | 2016122524 | A | 7/2016 | |
| WO | 2015121874 | A1 | 8/2015 | |

* cited by examiner

PLUG CONNECTOR

PRIORITY CLAIM

This patent application is a U.S. National Phase of International Patent Application No. PCT/EP2019/071941, filed 15 Aug. 2019, which claims priority to German Patent Application No. 10 2018 120 104.4, filed 17 Aug. 2018, the disclosures of which are incorporated herein by reference in their entireties.

SUMMARY

Illustrative embodiments relate to a plug connector for providing an electrical connection on a device part in a transportation vehicle, such as, for example, a door handle, an engine control device or an airbag control device. Illustrative embodiments also relate to a method for producing a corresponding plug connector.

BRIEF DESCRIPTION OF THE DRAWINGS

Disclosed embodiments will be described in more detail below with reference to the figures. Here, the features mentioned in the claims and in the description may be essential to the embodiments individually in each case or in any desired combination. It should be noted here that the figures have only a describing character and are not intended to restrict the embodiments. In the figures:

DETAILED DESCRIPTION

Figure 1:
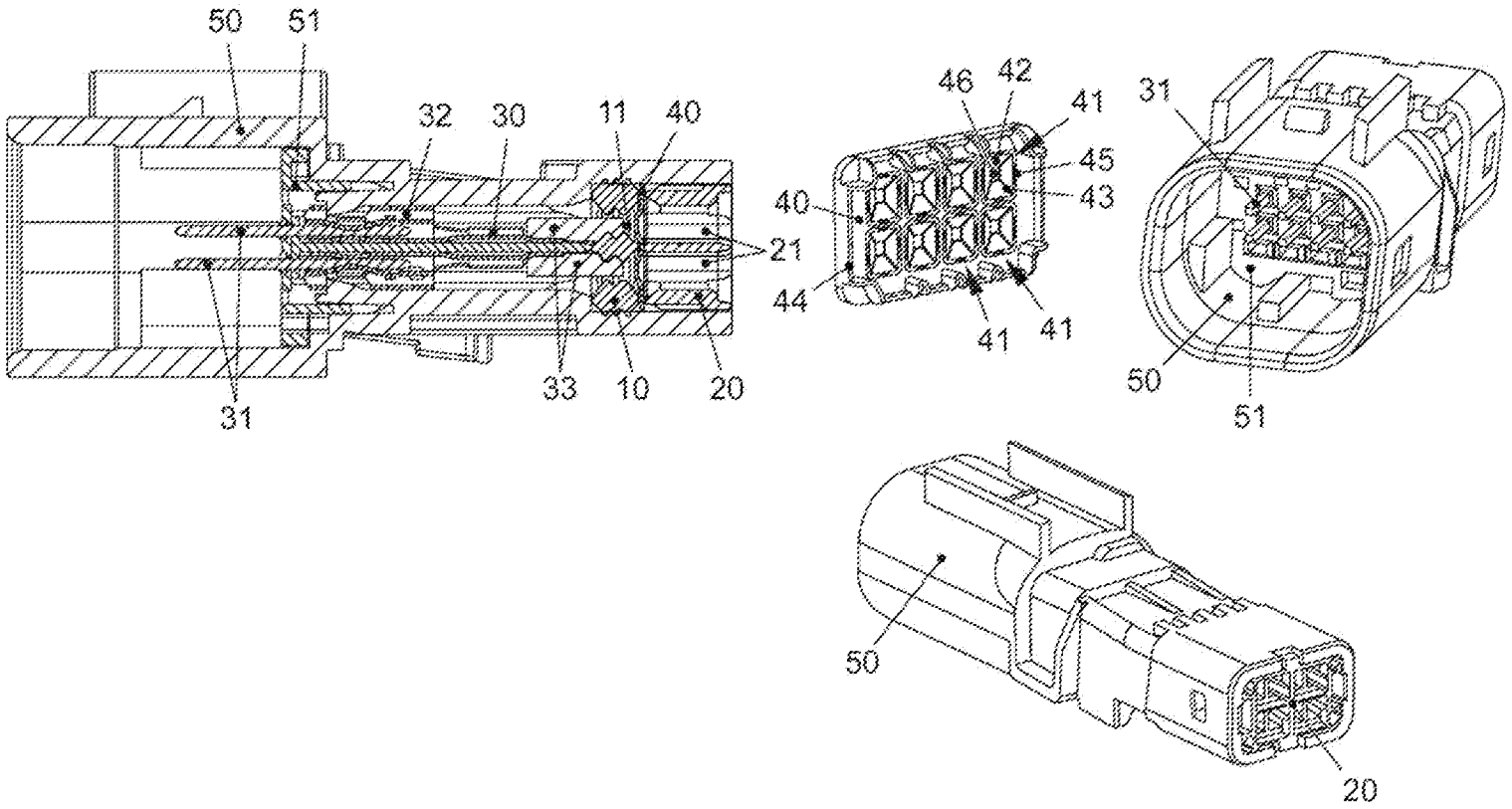
FIG. 1 shows a sectional illustration and different views of an assembled plug connector after a family seal has been equipped with a plug-in contact.

In the case of plug connectors which have an installation space-optimized arrangement, it is often the case that combined plug-in connections, for example, by family seals, such as mat seals, are used to save installation space for individual line insulations of different plug-in contacts. Such family seals are suitable for guiding through relatively thin plug-in contacts in the plug connectors on the socket side (female). In the case of the plug connectors on the plug side (male), thicker plug-in contacts are used than on the socket side. During contact mounting, the contact elements are pushed through the mat seal. There is the risk here that the plug-in contacts can damage, for example, pierce, the relatively soft mat seal when mounting the plug-in contact. For this reason, mat seals have up until now only been used in connection with plug connectors on the socket side (female). On the plug side, the plug-in contacts are usually simply encapsulated with a potting compound within a plug housing. However, the encapsulation can occur only after the final mounting of all the contact elements in the plug housing. However, this limits the mounting freedom with different plug-in contacts or with a different number of plug-in contacts and excludes retrofitting and/or subsequent maintenance of such plug connectors. In addition, to guide the plug-in contacts through the family seals, the punched edges thereof have to be carefully deburred to avoid damage to the seal during contact mounting, which is associated with a considerable production effort.

Disclosed embodiments provide a plug connector for providing an electrical connection on a device part in a transportation vehicle, such as, for example, a door handle, an engine control device or an airbag control device, which is simple, cost-effective and quick to produce, which allows automatic equipping of the plug connector, which is reliably sealed, which has an extended service life and which can be assembled and/or converted in an adaptable manner and can be easily maintained.

Disclosed embodiments provide a plug connector for providing an electrical connection and a method for producing a corresponding plug connector. Features which are disclosed in relation to the individual embodiments can be combined with one another in such a way that reference is or can always be made reciprocally with respect to the disclosure of the embodiments.

The disclosed embodiments provide a plug connector for providing an electrical connection, in particular, on a device part in a transportation vehicle, such as, for example, a door handle, an engine control device or an airbag control device, having: a family seal or a mat seal having at least one passage opening and at least one electrically conducting plug-in contact which can be guided through the at least one passage opening in the family seal. For this purpose, there is provision that a template for the passage opening is provided to support the plug-in contact when it is guided through the passage opening in the family seal.

For the purposes of the disclosure, the template can be understood to mean a guide and/or centering device, in particular, a guide and/or centering film, having a corresponding guide unit for the passage opening. The template, in particular, the guide unit, can in turn have a replicating guide geometry for the passage opening. The guide geometry can be designed as a (3D) guide geometry having a certain depth. The template can be of film-like configuration and be arranged flat on one side of the family seal. By virtue of the template bearing on one side of the family seal it is possible for the guide geometry to penetrate into the passage opening at least in part.

The disclosed plug connector is suitable as a device plug, optionally on the plug side (male) or on the device side of two complementary plug-in connections, which plug can have relatively hard and/or thick plug-in contacts. Nevertheless, it is also conceivable, however, that the disclosed embodiments can also be used with plug connectors on the socket side (female) also to increase the quality and the reliability with the plug sockets and also to simplify production thereof. In the case of a plug-in contact within the context of the disclosure, the plug-in contact can be formed with a connection line both on the socket side and on the plug side.

The idea of the disclosure lies here in the fact that, to produce the plug connector, a template for the passage opening is provided that, when guiding through the plug-in contact, aligns the tip of the contact plug with the passage opening in the family seal, with the result that the plug tip does not penetrate into the seal but is guided through the passage opening in the family seal in a targeted manner. The template has the effect of aligning the plug-in contact along the surface of the template, optionally on a guiding unit of the template, until the plug tip strikes the passage opening in the mat seal precisely and is then guided gently through this passage opening. This can be achieved by a particular formation of a, for example, funnel-shaped, guide geometry, which can at least in part project into the passage opening in the family seal, and/or by a certain material composition, for example, an elastic film, of the template. The formation of the guide geometry can influence the angle of incidence of the plug tip to the surface of the family seal, the angle being able to bring about sliding along the template instead of the plug tip stabbing into the material of the mat seal. The template can be an elastic film which can bring about damped placement of the plug tip. Here, the template can be applied as a retrofit component for the plug connector, at least temporarily or permanently.

is usually the case that family seals have a plurality of passage openings which can be equipped with plug-in contacts according to requirement. The disclosed template can be formed with a corresponding guide geometry for all the passage openings in the family seal. In other words, the disclosed template can have a guide geometry which replicates all the passage openings in the family seal. Furthermore, the template can have a respective guide unit for each passage opening. The respective guide unit can have a funnel-shaped guide geometry which tapers in the direction of the passage openings in the family seal. The guide unit can also have, at a lower point, a complementary opening for the passage opening. Furthermore, it is conceivable that the guide unit can have flaps which can be opened in the direction of the passage openings in the family seal. Moreover, the guide unit can have a predetermined breaking geometry, for example, between the flaps, to facilitate passage of the plug tip.

A plug connector is therefore made possible which is simple, cost-effective and quick to produce, which allows automatic equipping of the plug connector, which is reliably sealed, which has an extended service life and which can be assembled and/or converted in an adaptable manner and can be easily maintained.

Furthermore, the disclosed embodiments can provide, in the case of a plug connector, that the template is of elastic and/or film-like design. Such a template can cushion and resiliently deform to be able to align the plug-in contact. In addition, such a template can have a thin material thickness and be arranged without significant installation space losses in the plug connector.

Furthermore, the disclosed embodiments, in the case of a plug connector, can provide that the template bears loosely against the family seal. Consequently, the mounting of the template within the plug connector or the assembly of the plug connector can occur in a simple manner without great mounting effort.

Within the scope of the disclosure, it is furthermore conceivable that the template can have a material thickness of 0.1 mm to 0.2 mm, optionally 0.15 mm. A thin template having elastic properties can thus be provided.

Moreover, it is conceivable that the template can have a depth of 1 mm to 1.2 mm, in particular, 1.1 mm. It is thus possible to bring about partial penetration of a guide unit of the template into the respective passage opening, with the result that the plug tip can be aligned precisely with the passage opening in the family seal.

In addition, the disclosed embodiments, in the case of a plug connector, can provide that the template has at least one guide unit to align the plug-in contact in the direction of the passage opening, with the guide unit being able to have a funnel-shaped guide geometry. The funnel-shaped guide geometry can have a depth of 0.5 mm to 0.7 mm, optionally 0.6 mm. Consequently, the template can provide a replicating guide geometry for the passage opening. The guide unit ensures that, when equipping the family seal, the plug tip first of all strikes the template and is aligned by the guide unit with the passage opening before it is guided through the passage opening. A situation can thus be avoided in which the plug tip stabs into the family seal.

Furthermore, the disclosed template can have swing-open guide elements which can be opened in the passage opening in the family seal by the plug-in contact. Consequently, the alignment of the plug tip can be considerably simplified and virtually frictionless guiding of the plug tip through the passage opening can be made possible. The guide elements can be fastened to the respective guide unit by hinge elements.

Furthermore, the disclosed embodiments, in the case of a plug connector, can provide that the template has a predetermined breaking geometry which can be opened in the direction of the passage opening by the plug-in contact. In addition or instead, the template can have a complementary opening for the passage opening. The predetermined breaking geometry ensures that, after aligning the plug tip, disturbance-free guiding of the plug tip through the passage opening can be made possible.

Furthermore, the disclosed template can have a collar element which can serve for positioning a holding element or a seal holding grid for the template on a plug housing. The collar element can surround the template as a shell, with the result that a receptacle for the holding element is created within the template. Mounting the holding element simultaneously allows the template to be arranged captively on the family seal. The template is thus arranged between the family seal and the holding element. The collar element can surround the foot of the holding element in the region of the bearing surface on the template.

Furthermore, the disclosed embodiments provide a method for producing a plug connector, having: a family seal having at least one passage opening, and at least one electrically conducting plug-in contact which is guided through the at least one passage opening in the family seal. For this purpose, there is provision that, when guiding the plug-in contact through the passage opening in the family seal, use is made of a template to guide the plug-in contact through the passage opening in the family seal in a targeted manner. By using the disclosed method the same benefits that have been described above in connection with the plug connector are achieved. To avoid repetitions, reference is made comprehensively thereto in the present case.

Furthermore, the method can provide that, after guiding the plug-in contact through the passage opening in the family seal, the template remains on the family seal during normal operation of the plug connector. Putting the plug connector into operation can thus be accelerated.

In the figures which follow, identical reference signs are used for the same technical features, even of different exemplary embodiments.

FIG. 1 shows a plug connector 100 after a family seal 10, such as a mat seal 10 has been equipped with an electrically conducting plug-in contact 30. The mat seal 10 has a plurality of passage openings 11 for one plug-in contact 30 each which are able to be equipped or left free according to requirements. The mat seal 10 is accommodated in a plug housing 50 together with a holding element 20 or a seal holding grid having an opening 21 for a connection line 33.

The family seals 10 are conventionally equipped only with relatively thin plug-in contacts 30 in the plug connectors 100 on the socket side (female). In the case of the plug connectors 100 on the plug side (male), thicker plug-in contacts 30 are used than on the socket side. What can occur when guiding such thicker contact elements through the mat seal 10 is that the plug-in contacts 30 can damage, for example, pierce, the relatively soft mat seal 10.

The disclosed embodiments provide a plug connector 100 which allows the family seal 10, even in the case of a plug connector 100 on the plug side, to be equipped with relatively thick plug-in contacts 30 in a gentle manner without damaging the family seal 10.

For this purpose, the disclosed embodiments provide a template 40 for the passage opening 11 to support the plug-in contact 30 when it is guided through the passage opening 11 in the family seal 10.

As can be seen in FIG. 1, the template 40 can be a guide and/or centering film. The guide film is configured with in each case a corresponding guide unit 41 for the respective passage opening 11 in the mat seal 10. The template 40, in particular, the guide unit 41, can have a replicating guide geometry for the passage opening 11 (cf. FIG. 2). Within the scope of the disclosure, the guide geometry can be designed as a (3D) guide geometry with a certain depth t2 (cf. FIG. 4). Here, the template 40 can be applied as a retrofit component for the plug connector 100, at least temporarily for equipping the mat seal 10 or permanently for the operation of the plug connector 100.

Figure 2:
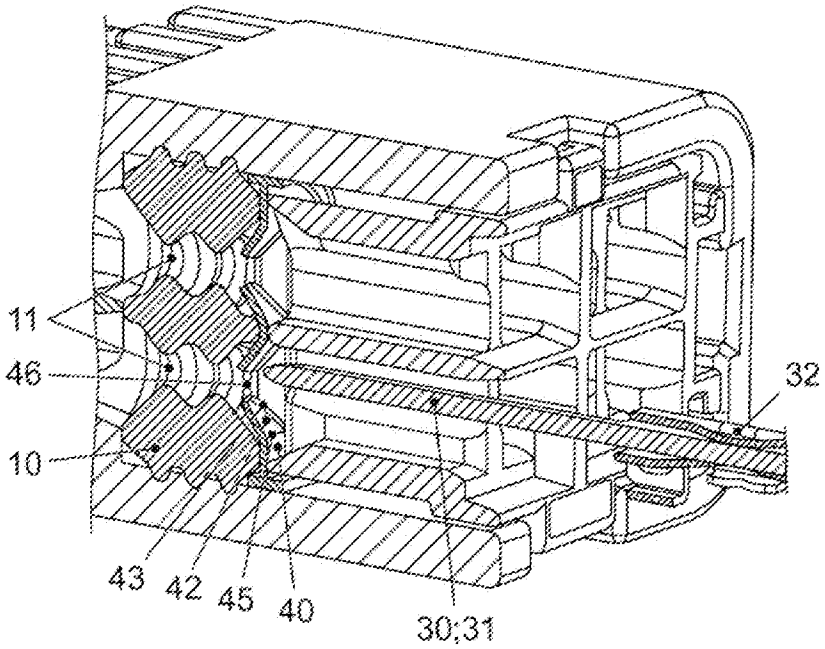
FIG. 2 shows an enlarged illustration of a plug-in contact when the plug-in contact is guided through a template.
Figure 3:
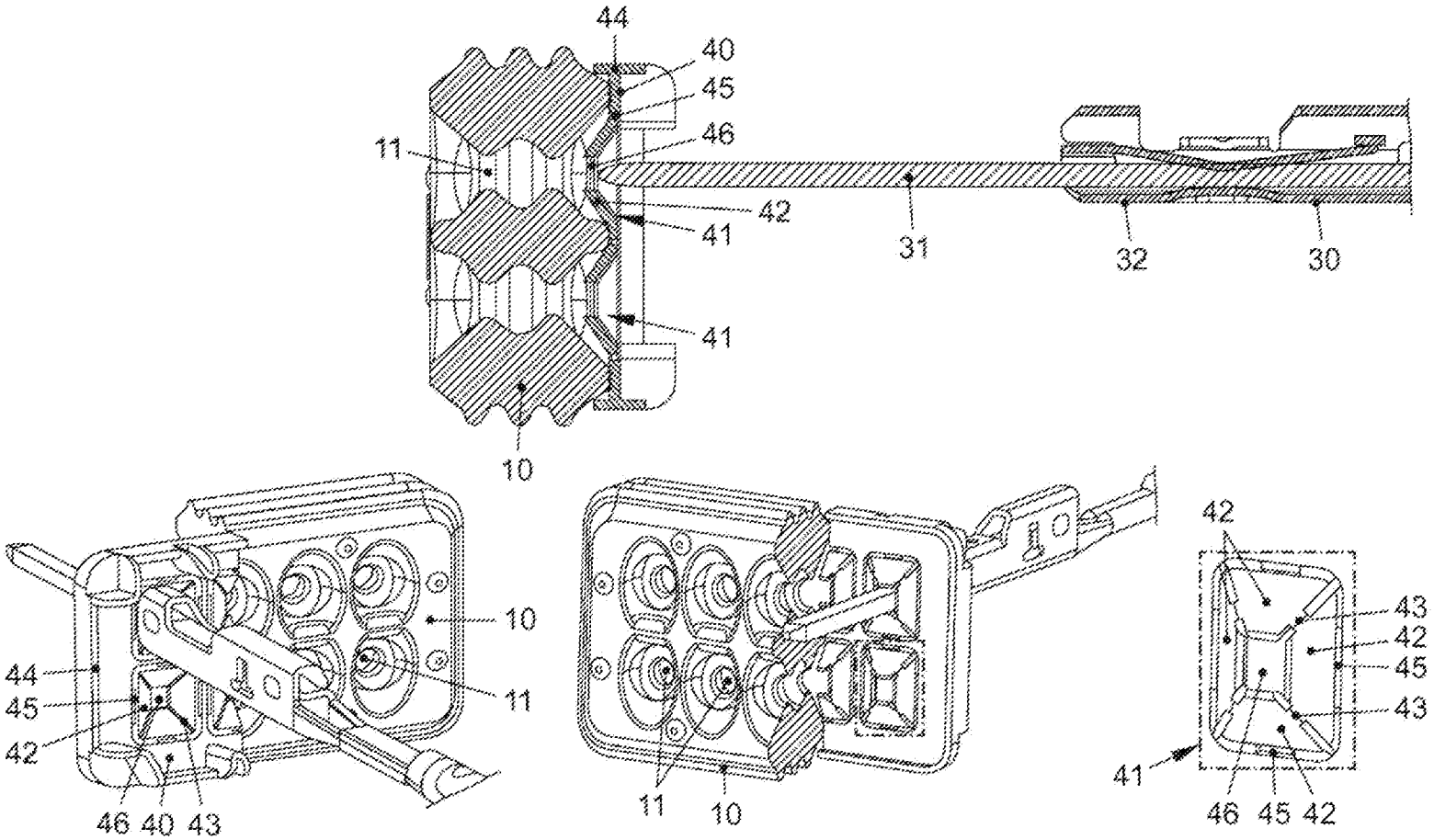
FIG. 3 shows different views of a plug-in contact after the plug-in contact has been guided through a template.

As can be seen in FIGS. 1 to 3, the template 40 is arranged flat on one side of the family seal 10, with the result that the respective guide unit 41 can penetrate at least in part into the corresponding passage opening 11 in the mat seal 10 (cf. FIG. 2). The template 40 need be only loosely arranged on the family seal 10. When the holding element 20 is positioned on the template 40, the template 40 can no longer slip. The template 40 is in other words positioned between the mat seal 10 and the holding element 20. The template 40 can further have a collar element 44, at least in part, to enclose the holding element 20 in a region of the bearing surface on the template 40. The template 40 is thus held reliably in its position.

A closure grid 51 or a locking plate is then placed in front of the other side of the plug connector 100. The closure grid 51 and/or the plug housing 50 in the region of the closure grid 51 can interact in a form-fitting and/or force-fitting manner with a plug geometry 32 or with a so-called contact box on the plug-in contact 30 to fasten the plug-in contact 30 to the plug connector 100.

As FIG. 2 shows, the disclosed template 40, when guiding the plug tip 31 through the passage opening 11 in the family seal 10, provides assistance in that it precisely aligns the plug tip 31 by using the guide unit 41 so that the plug tip 31 does not penetrate into the family seal 10, but rather is guided through the passage opening 11 in the family seal 10 in a targeted manner.

As FIG. 2 further shows, the template 40 has the effect of aligning the plug-in contact 30 on the guide unit 41 of the template 40 until the plug tip 31 precisely strikes the passage opening 11 in the mat seal 10. The plug tip 31 can thereafter be guided gently through the passage opening 11.

Figure 4:
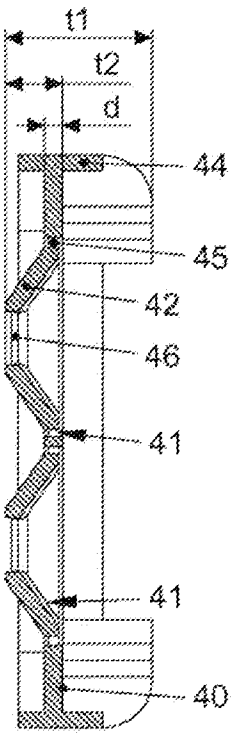
FIG. 4 shows different views of a template.
Figure 4:
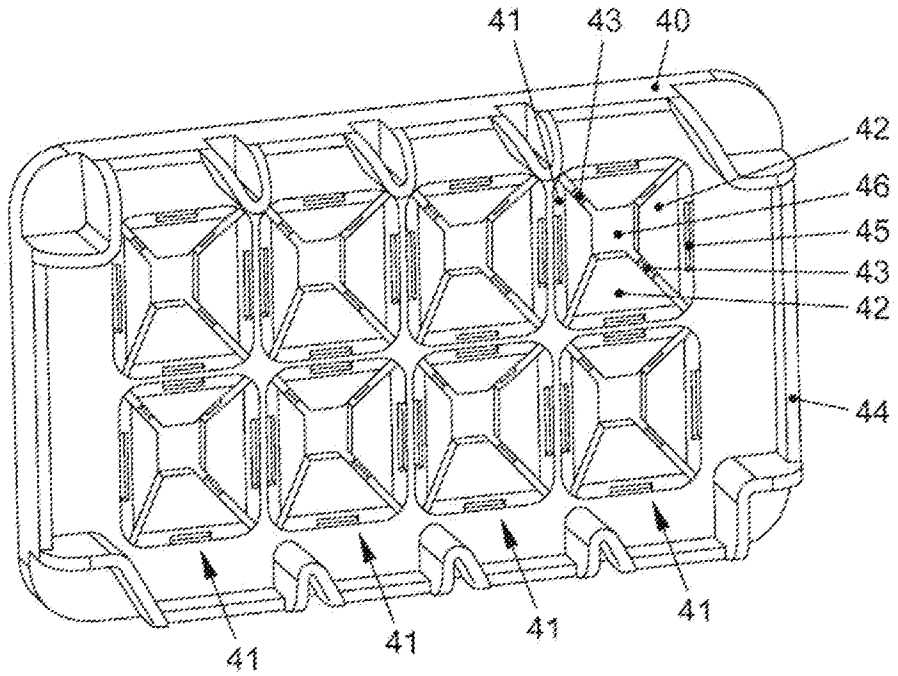

Since the family seals 10 usually have a plurality of passage openings 11 which are equipped with plug-in contacts 30 according to requirement, the template 40 within the context of the disclosure can also be formed with a corresponding guide geometry for all the passage openings 11 in the family seal 10 that can replicate all the passage openings 11 in the family seal 10 (cf. FIG. 4). Within the scope of the disclosure, the template 40 can in each case have a guide unit 41 for each passage opening 11. The respective guide unit 41 can have a funnel-shaped guide geometry which can taper in the direction of the passage openings 11 in the family seal 10.

As FIG. 3 shows, the guide unit 41 can have guide elements 42 such as flaps, that can be opened in the direction of the passage opening 11 in the family seal 10. The guide elements 42 can be fastened to the respective guide unit 41 by hinge elements 45, in particular, film hinges. Moreover, the guide unit 41 can have a predetermined breaking geometry 43, for example, between the flaps, to facilitate passage of the plug tip 31. In addition or instead, the guide unit 41 can have, at a lower point, a complementary opening 46 for the passage opening 11.

Furthermore, FIG. 4 shows the disclosed template 40 in isolation. The template 40 can have a material thickness d of 0.1 mm to 0.2 mm, optionally 0.15 mm, and a depth t1 of 1 mm to 1.2 mm, in particular, 1.1 mm. The depth t2 of the funnel-shaped guide geometry can lie in the range from 0.5 mm to 0.7 mm, optionally being 0.6 mm.

The above description of the figures describes the present disclosure exclusively within the context of examples. Of course, individual features of the illustrative embodiments, where technically feasible, may be freely combined with one another without departing from the scope of the disclosure.

LIST OF REFERENCE SIGNS

10 Family seal, mat seal
11 Passage opening
20 Holding element
21 Opening
30 Plug-in contact
31 Plug tip
32 Plug geometry
33 Connection line
40 Template
41 Guide unit
42 Guide element
43 Predetermined breaking geometry
44 Collar element
45 Hinge element
46 Complementary opening
50 Plug housing
51 Closure grid
100 Plug connector
d Material thickness
t1 Depth
t2 Depth

The invention claimed is:

1. A plug connector for providing an electrical connection, the plug connector comprising:

a family seal with at least one passage opening; and at least one electrically conducting plug-in contact, which is guided through the at least one passage opening in the family seal, wherein a template for the passage opening is provided to support the plug-in contact when the plug-in contact is guided through the passage opening in the family seal, wherein the template has at least one guide unit to align the plug-in contact in the direction of the passage opening, wherein the template has swing-open guide elements which are opened in the passage opening in the family seal by the plug-in contact, wherein the guide elements are fastened to the respective guide unit by hinge elements and wherein the template is a film.

2. The plug connector of claim 1, wherein the template is elastic.

3. The plug connector of claim 1, wherein the template bears loosely against the family seal.

4. The plug connector of claim 1, wherein the template has a material thickness of 0.1 mm to 0.2 mm, and/or the template has a depth of 1 mm to 1.2 mm.

5. The plug connector of claim 1, wherein the guide unit has a funnel-shaped guide geometry, and/or the funnel-shaped guide geometry has a depth of 0.5 mm to 0.7 mm.

6. The plug connector of claim 1, wherein the template has a predetermined breaking geometry which is opened in the direction of the passage opening by the plug-in contact.

7. The plug connector of claim 1, wherein the template has a collar element which serves for positioning a holding element for the template on a plug housing.

8. A method for producing a plug connector comprising:

a family seal with at least one passage opening; and at least one electrically conducting plug-in contact, which is guided through the at least one passage opening in the family seal, wherein, when guiding the plug-in contact through the passage opening in the family seal, a template is used to guide the plug-in contact targetedly through the passage opening in the family seal, wherein the template used has at least one guide unit to align the plug-in contact in the direction of the passage opening, wherein the template used has swing-open guide elements which are opened in the passage opening in the family seal by the plug-in contact, wherein the guide elements used are fastened to the respective guide unit by hinge elements, and wherein the template is a film.

9. The method of claim 8, wherein, after guiding the plug-in contact through the passage opening in the family seal, the template remains on the family seal during normal operation of the plug connector.

10. The method of claim 8, wherein the template used is elastic.

11. The method of claim 8, wherein the template used bears loosely against the family seal.

12. The method of claim 8, wherein the template used has a material thickness of 0.1 mm to 0.2 mm, and/or a depth of 1 mm to 1.2 mm.

13. The method of claim 8, wherein the guide unit used has a funnel-shaped guide geometry, and/or the funnel-shaped guide geometry has a depth of 0.5 mm to 0.7 mm.

14. The method of claim 8, wherein the template used has a predetermined breaking geometry which is opened in the direction of the passage opening by the plug-in contact.

15. The method of claim 8, wherein the template used has a collar element which serves for positioning a holding element for the template on a plug housing.

* * * * *